United States Patent [19]

Shelar

[11] Patent Number: 4,708,151

[45] Date of Patent: Nov. 24, 1987

[54] PIPE WITH REPLACEABLE CARTRIDGE

[75] Inventor: Gary R. Shelar, Greensboro, N.C.

[73] Assignee: R. J. Reynolds Tobacco Company, Winston-Salem, N.C.

[21] Appl. No.: 840,114

[22] Filed: Mar. 14, 1986

[51] Int. Cl.[4] ..... A24D 1/18; A24F 3/00; A24F 5/00

[52] U.S. Cl. ..... 131/359; 131/329; 131/226; 131/194; 131/196

[58] Field of Search ..... 131/359, 369, 329, 194, 131/196, 330, 226

[56] References Cited

U.S. PATENT DOCUMENTS

| | | | |
|---|---|---|---|
| 4,219,032 | 8/1980 | Tabtznik et al. | 131/330 |
| 4,347,855 | 9/1982 | Lanzillotti et al. | 131/78 |
| 4,391,285 | 7/1983 | Burnett et al. | 131/364 |
| 4,474,191 | 10/1984 | Steiner | 131/198.1 |
| 4,596,258 | 6/1986 | Steiner | 131/198.1 |

FOREIGN PATENT DOCUMENTS

| | | |
|---|---|---|
| 1294351 | 9/1975 | Fed. Rep. of Germany . |
| 42-8684 | 12/1967 | Japan . |
| 13985/3890 | 9/1985 | Liberia . |

OTHER PUBLICATIONS

"Methods for Detecting Carcinogens and Mutogens with the Salmonella/Mammalian-Microseme Mutoglucity Test", Mutation Research 31 (1975), 347-364, (Elsevier Scientific Publishing Company Amsterdam--printed in the Netherlands).

Mutation Research 38 (1976) 241.

Mutation Research 42 (1977) 335-342.

Ames et al., Mut. Res. 31:347-364 (1975).

Nagao et al., Mut. Res. 42:335 (1977).

*Primary Examiner*—V. Millin

*Attorney, Agent, or Firm*—Grover M. Myers; David G. Conlin

[57] ABSTRACT

The present invention relates to a smoking article which has the appearance of a conventional pipe. The pipe of the present invention is capable of producing substantial quantities of aerosol, preferably without significant thermal degradation of the aerosol former and without the presence of substantial pyrolysis or incomplete combustion products.

These and other advantages are obtained by providing a pipe which includes a disposable cartridge containing a short, i.e., less than about 30 mm long, preferably carbonaceous, fuel element, a physically separate aerosol generating means including an aerosol forming substance, and means for retaining the cartridge within the pipe bowl.

5 Claims, 4 Drawing Figures

PIPE WITH REPLACEABLE CARTRIDGE

BACKGROUND OF THE INVENTION

The present invention relates to a pipe which produces an aerosol that resembles tobacco smoke and which preferably contains no more than a minimal amount of incomplete combustion or pyrolysis products.

Many pipe-type smoking articles have been proposed through the years, especially over the last 20 to 30 years. However, none has had any apparent consumer acceptance.

For example, U.S. Pat. No. 4,347,855 to Lanzillotti et al. and U.S. Pat. No. 4,391,285 to Burnett et al. each describe pipe-type smoking articles which use an extruded tobacco containing material for the generation of an aerosol.

Similarly, Steiner, in U.S. Pat. No. 4,474,191 describes "smoking devices" including pipe embodiments (see, FIGS. 1–4 and 11–13), which contain an air-intake channel which is generally isolated from the combustion chamber by a fire resistant wall. In the Steiner devices, the fuel is separated from the aerosol generating material by a conductive wall. To assist in the lighting of the device, Steiner may provide means for allowing the brief, temporary passage of air between the combustion chamber and the air-intake channel.

However, despite decades of interest and effort, there is still no pipe-type smoking article on the market which provides the benefits and advantages associated with conventional pipe smoking, without delivering considerable quantities of incomplete combustion and pyrolysis products.

SUMMARY OF THE INVENTION

The present invention relates to a pipe which is capable of producing substantial quantities of aerosol throughout the period of normal use, preferably without significant thermal degradation of the aerosol former and without the presence of substantial pyrolysis or incomplete combustion products.

These and other advantages are obtained by providing a pipe which includes (a) a replaceable cartridge containing a short, i.e., less than about 30 mm long, preferably carbonaceous, fuel element, and a physically separate aerosol generating means including an aerosol forming substance, and (b) a means for retaining the cartridge within the pipe. In preferred embodiments, the cartridge does not extend above the rim of the pipe bowl.

The pipe of the present invention is particularly advantageous in that both the fuel and the aerosol forming materials are contained within a single replaceable cartridge. The use of such a cartridge avoids the multiple step recharging problems of prior art pipe-type smoking articles such as those of Steiner.

The retaining means of the pipe of the present invention may comprise a removable member having a hole adapted to receive one end of the cartridge which also is aligned with the passageway through stem, such that aerosol forming materials may freely pass from the cartridge to the stem passageway and be delivered to the user as a smoke-like aerosol. Preferably, the retaining means for the pipe of the present invention incorporates an ejection means by which spent cartridges may be easily removed from the pipe bowl.

Preferably, the aerosol generating means and the fuel element of the cartridge are in a conductive heat exchange relationship, and/or the aerosol forming substance is located within a heat conductive container provided with passages through which gases and vapors may pass into the pipe stem and be delivered to the user akin to conventional pipe tobacco smoke.

The fuel elements used in the cartridge are preferably less than about 20 mm in length, more preferably less than about 15 mm in length, and have a density of at least about 0.5 g/cc, preferably at least about 0.7 g/cc, as measured by mercury intrusion. Preferred fuel element are normally provided with one or more longitudinal passageways, preferably from 5 to 9 passageways, which help to control the transfer of heat from the fuel element to the aerosol forming substance.

The heat exchange relationship between the fuel and the aerosol generator is preferably achieved by providing a heat conducting member, such as a metal conductor, which contacts the fuel element and at least a portion of the aerosol generating means, and preferably forms the conductive container for the aerosol forming materials.

Preferred cartridges of the type described herein are particularly advantageous because the hot, burning fire cone is always close to the aerosol generating means, which maximizes heat transfer thereto and maximizes the resultant production of aerosol, especially in embodiments which are provided with a multiple passageway fuel element and a heat conducting member. In addition, because the aerosol forming substance is physically separate from the fuel element, it is exposed to substantially lower temperatures than are present in the burning fire cone, thereby minimizing the possibility of thermal degradation of the aerosol former.

The aerosol generating means may include a charge of tobacco to add additional tobacco flavors to the aerosol. Advantageously, this tobacco charge may be placed at the stem end of the cartridge and/or it may be mixed with a carrier for the aerosol forming substance. Other substances, such as flavoring agents, may be incorporated in a similar manner. In some embodiments, a tobacco charge may be used as the carrier for the aerosol forming substance. Tobacco or a tobacco extract flavor may alternatively, or additionally, be incorporated in the fuel element to provide additional tobacco flavor.

In addition to the aforementioned benefits, preferred pipes of the present invention are capable of providing an aerosol which is chemically simple, consisting essentially of air, oxides of carbon, water, the aerosol former, any desired flavors or other desired volatile materials, and trace amounts of other materials. This aerosol has no significant mutagenic activity as measured by the Ames Test.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element, and/or by utilizing a conductive member to carry heat from the burning fuel to the aerosol generating means. Preferably both methods of providing conductive heat transfer are used.

As used herein, the term "carbonaceous" means primarily comprising carbon.

The preferred pipes and cartridges of the present invention are described in greater detail in the accompanying drawing and in the detail description of the invention which follow.

DETAILED DESCRIPTION OF THE PREFERRED EMBODIMENTS

Figure 1:
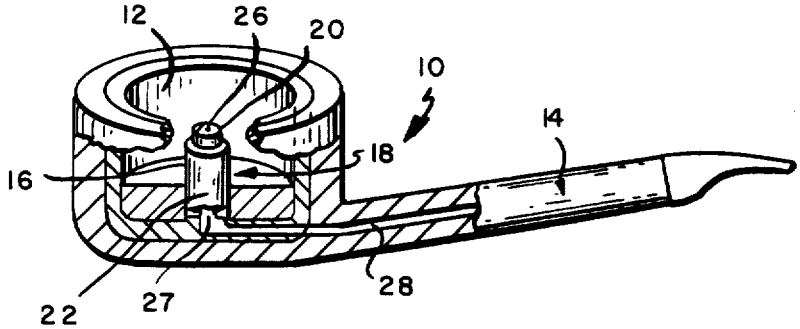
FIG. 1 is a perspective view of a pipe according to the present invention having a portion of the bowl and stem removed, showing the cartridge and the bowl conversion member.
Figure 2:
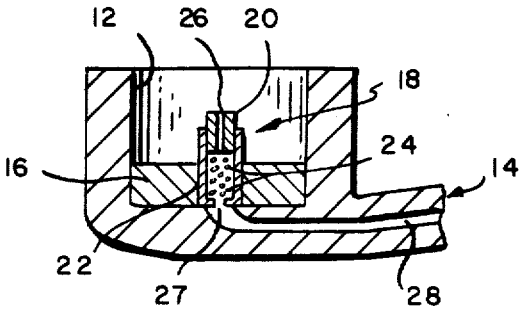
FIG. 2 is a sectional view of the bowl/stem arrangement of the pipe of FIG. 1, illustrating the placement of the cartridge and the bowl conversion member of the present invention.

The embodiment of the invention illustrated in FIGS. 1 and 2, has about the same overall dimensions as a conventional pipe. It includes a conventional pipe 10 comprising a bowl 12, a stem 14, an annular bowl conversion member 16, and a replaceable cartridge 18. The cartridge 18 includes a short, combustible carbonaceous fuel element 20 inserted into a heat conductive container 22, which container encloses a substrate 24 bearing at least one aerosol forming substance. Cartridge 18 fits into bowl conversion member 16 making the cartridge useful in any conventional pipe.

Figure 4:
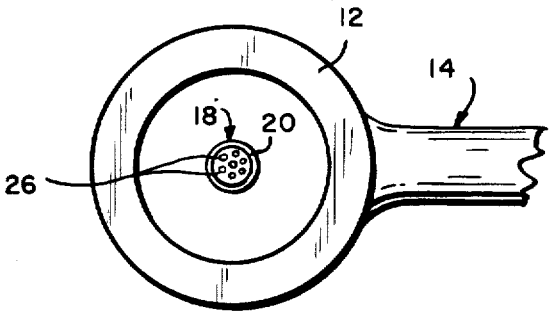
FIG. 4 is a top view of the pipe of FIG. 3, illustrating the relative size of the preferred fuel element to the bowl and one preferred arrangement of fuel element passageways.

In the embodiment shown in FIGS. 1 and 2, the carbonaceous fuel element 20 is about 10 mm long and about 4.5 mm in diameter, and is provided with seven passageways 26, as illustrated in FIG. 4. The heat conductive container 22, is a metal, e.g., aluminum, tube about 30 mm long and about 4.5 mm in diameter. The substrate 24 may be, for example about 200 mg of granular alumina, bearing one or more aerosol forming substances such as glycerin, tobacco extracts, and/or flavors. The bottom end of the container is sealed to retain the substrate but includes at least one opening 27 to allow the passage of aerosol forming gases to the passageway 28 in the stem 14. The fuel element 20 extends about 7 mm beyond the open end of the container 22.

The bowl conversion member 16 is generally an annular member designed to receive up to about 5 mm of the bottom portion of the cartridge 16. The conversion member 16 is also designed to fit snugly into the bottom of the pipe bowl 12. The hole in the annular member 16 is preferably aligned with the opening to passageway 28 in the stem 14 of the pipe.

In preferred embodiments, such as the illustrated embodiments, the cartridge does not extend beyond the rim of the pipe bowl. Generally, the distance from the top of the fuel element in the cartridge and the rim of the pipe bowl is at least about 1 mm, preferably about 3 mm or more. This recessed cartridge decreases the possibility that careless handling will cause a fire or burn the user.

Figure 3:
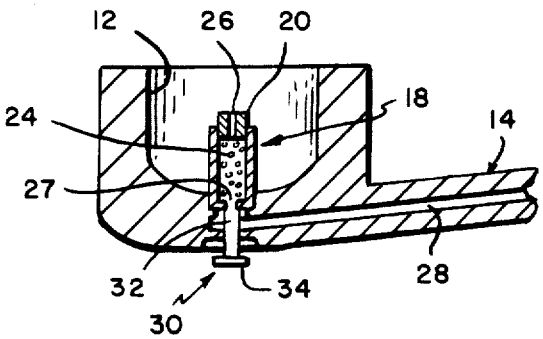
FIG. 3 is a sectional view of another pipe of the present invention, having its bowl modified to directly accept the cartridge of the present invention and illustrating one cartridge ejection means.

As illustrated in FIG. 3, the pipe bowl 12 may be shaped to accept the cartridge 18 and may include a cartridge ejection means 30. As illustrated in FIG. 3, one such ejection means comprises an elongated member 32, slidably mounted through the bottom of the pipe bowl 12, to engage the bottom of the cartridge 18. The elongated member 32 is designed so as not to obstruct the passageway 28 of stem 14 and may include an enlarged knob 34.

Upon lighting, the fuel element burns, generating the heat used to volatilize the aerosol forming substance or substances in the aerosol generating means. Because the preferred fuel element is relatively short, the hot, burning fire cone is always close to the aerosol generating means, which maximizes heat transfer to the aerosol generating means and resultant production of aerosol, especially when the preferred heat conducting member is used.

The small size and burning characteristics of the preferred fuel elements employed in the present invention ensure that the fuel element will begin to burn over substantially all of its exposed length within a few puffs. Thus, that portion of the fuel element adjacent to the aerosol generator becomes hot quickly, which significantly increases heat transfer to the aerosol generator, especially during the early and middle puffs. Control of heat transfer to the aerosol generating means is important both in terms of transferring enough heat to produce sufficient aerosol and in terms of avoiding the transfer of so much heat that the aerosol former is degraded. Heat transfer is enhanced by the heat conductive material employed in the preferred conductive container for the aerosol forming substances, which aids in the distribution of heat to that portion of the aerosol forming substance which is physically remote from the fuel. This helps produce good aerosol, especially in the early and middle puffs. The control of heat transfer from the fuel element to the aerosol generating means is also aided by the presence of a plurality of passageways in the fuel element, which allow the rapid passage of hot gases to the aerosol generator, especially during puffing.

Because the aerosol forming substance is physically separate from the fuel element, the aerosol forming substance is exposed to substantially lower temperatures than are generated by the burning fuel, thereby minimizing the possibility of its thermal degradation. This also results in aerosol production almost exclusively during puffing, with little or no aerosol production from the aerosol generating means during smolder.

In the preferred embodiments of the invention, the short carbonaceous fuel element and the aerosol generator cooperate to provide a system which is capable of producing substantial quantities of aerosol, on virtually every puff. The close proximity of the fire cone to the aerosol generator after a few puffs, together with the conductive elements of the container, result in high heat delivery both during puffing and during the relatively long period of smolder between puffs.

In general, the combustible fuel elements which may be employed in the cartridges of the present invention have a diameter of at least about 2 mm, preferably from about 4 mm to 8 mm, and are generally less than about 30 mm long. Advantageously the fuel element is about 20 mm or less in length, preferably about 15 mm or less in length. The density of the fuel elements employed herein may range from about 0.5 g/cc to about 1.5 g/cc, as measured by mercury porosity. Preferably the density is greater than about 0.7 g/cc, more preferably greater than about 0.8 g/cc.

The preferred fuel elements employed herein are primarily formed of a carbonaceous material. Carbonaceous fuel elements are preferably from about 5 to 15 mm, more preferably, from about 8 to 12 mm in length. Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% carbon by weight, are within the scope of this invention, especially where a minor amount of tobacco, tobacco extract, or a nonburning inert filler is used.

Also, while not preferred, other fuel materials may be employed in the cartridge, such as tobacco, tobacco substitutes and the like, provided that they generate and conduct sufficient heat to the aerosol generating means to produce the desired level of aerosol from the aerosol forming material, as discussed above. Where such other materials are used, it is much preferred to include carbon in the fuel, preferably in amounts of at least about 20% to 40% by weight, more preferably at least about 50% by weight, and most preferably at least about 65% to 70% by weight, the balance being the other fuel components, including any binder, burn modifiers, moisture, etc.

The carbonaceous materials used in or as the preferred fuel element may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources may be used.

In most instances, the carbonaceous fuel elements should be capable of being ignited by a conventional cigarette lighter without the use of an oxidizing agent. Burning characteristics of this type may generally be obtained from a cellulosic material which has been pyrolyzed at temperatures between about 400° C. to about 1000° C., preferably between about 500° C. to about 950° C., most preferably at about 750° C., in an inert atmosphere or under a vacuum. The pyrolysis time is not believed to be critical, as long as the temperature at the center of the pyrolyzed mass has reached the aforesaid temperature range for at least a few, e.g., about 15, minutes. A slow pyrolysis, employing gradually increasing temperatures over many hours, is believed to produce a uniform material with a high carbon yield. Preferably, the pyrolyzed material is then cooled, ground to a fine powder, and heated in an inert gas stream at a temperature between about 650° C. to 850° C. to remover volatiles prior to further processing.

While undesirable in most cases, carbonaceous materials which require the use of an oxidizing agent to render them ignitable by a cigarette lighter are within the scope of this invention, as are carbonaceous materials which require the use of a glow retardant or other type of combustion modifying agent. Such combustion modifying agents are disclosed in many patents and publications and are well known to those of ordinary skill in the art.

In certain preferred embodiments, the carbonaceous fuel elements are substantially free of volatile organic material. By that it is meant that the fuel element is not purposely impregnated or mixed with substantial amounts of volatile organic materials, such as volatile aerosol forming or flavoring agents, which could degrade in the burning fuel. However, small amounts of materials, e.g., water, which are naturally adsorbed by the carbon in the fuel element, may be present therein. Similarly, small amounts of aerosol forming substances may migrate from the aerosol generating means and thus may also be present in the fuel.

In other preferred embodiments, the fuel element may contain minor amounts of tobacco, tobacco extracts, and/or other materials, primarily to add flavor to the aerosol. Amounts of these additives may range up to about 25 weight percent or more, depending upon the additive, the fuel element, and the desired burning characteristics. Tobacco and/or tobacco extracts may be added to carbonaceous fuel elements at about 10 to 20 weight percent, thereby providing tobacco flavors to the mainstream and tobacco aroma to the sidestream akin to a conventional cigarette, without affecting the Ames test activity of the product.

A preferred carbonaceous fuel element is a pressed or extruded mass of carbon prepared from a powdered carbon and a binder, by pressure forming or extrusion techniques. A preferred activated carbon for such a fuel element is PCB-G, and a preferred non-activated carbon is PXC, both available from Calgon Carbon Corporation, Pittsburgh, PA. Other preferred nonactivated carbons for pressure forming are prepared from pyrolyzed cotton or pyrolyzed papers, such as non-talc containing grades of Grande Prairie Canadian Kraft, available from the Buckeye Cellulose Corporation of Memphis, TN.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel.

In general, an extruded carbonaceous fuel may be prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste having a stiff dough-like consistency. Minor amounts, e.g., up to about 35 weight percent, preferably about 10 to 20 weight percent, of tobacco, tobacco extract, and the like, may be added to the paste with additional water, if necessary, to maintain a stiff dough consistency. The dough is then formed, e.g., by using a standard ram or piston type extruder into the desired shape, and dried, preferably at about 95° C. to reduce the moisture content to about 2 to 7 percent by weight.

Carbonaceous fuel elements are preferably provided with one or more longitudinally extending passageways. These passageways help to control transfer of heat from the fuel element to the aerosol generating means, which is important both in terms of transferring enough heat to produce sufficient aerosol and in terms of avoiding the transfer of so much heat that the aerosol former is degraded. Generally, these passageways provide porosity and increase early heat transfer to the substrate by increasing the amount of hot gases which reach the substrate. They also tend to increase the rate of burning.

These passageways may be formed during the extrusion step. Alternatively, or additionally, the passageways may be formed using conventional drilling techniques. Generally, a large number of passageways, e.g., about 5 to 9 or more, especially with relatively wide spacings between the passageways, such as the configuration illustrated in FIG. 4 is preferred. If desired, the lighting end of the fuel elements may be tapered or reduced in diameter by machining, molding, or the like, to improve lightability.

A high quality fuel element may be formed by casting a thin slurry of the carbon/binder mixture (with or without additional components) into a sheet, drying the sheet, regarding the dried sheet into a powder, forming a stiff paste with water, and extruding the paste as described above.

If desired, carbon/binder fuel elements (without tobacco, and the like) may be pyrolyzed after formation, for example, to about 650° C. for two hours, to convert the binder to carbon and thereby form a virtually 100% carbon fuel element.

The fuel elements of the present invention also may contain one or more additives to improve burning, such as up to about 5 weight percent of sodium chloride to improve smoldering characteristics and as a glow retardant.

Also, up to about 5, preferably from about 1 to 2, weight percent of potassium carbonate may be included to control flammability. Additives to improve physical characteristics, such as clays like kaolins, serpentines, attapulgites and the like also may be used.

The aerosol generating means used in the cartridge of the present invention is physically separate from the fuel element. By physically separate it is meant that the substrate, container, or chamber which contains the aerosol forming materials is not mixed with, or a part of, the fuel element. This arrangement helps reduce or eliminate thermal degradation of the aerosol forming substance and the presence of sidestream smoke.

While not a part of the fuel element, the aerosol generating means generally abuts or is connected to the fuel element such that the fuel element and the aerosol generating means are in a conductive heat exchange relationship. Preferably, the conductive heat exchange relationship is achieved by providing a heat conductive member, such as a metal foil, recessed from the lighting end of the fuel element, which efficiently conducts or transfers heat from the burning fuel element to the aerosol generating means.

The preferred container for the aerosol generating means may vary in length from about 5 mm to about 40 mm, preferably from about 15 mm to 35 mm, and most preferably from about 20 mm to 30 mm. The diameter of the aerosol generating means should be at least about 2 mm, and preferably from about 4 mm to 8 mm.

Preferably, the aerosol generating means includes one or more thermally stable materials which carry one or more aerosol forming substances. As used herein, a "thermally stable" material is one capable of withstanding the high, albeit controlled, temperatures, e.g., from about 400° C. to about 600° C., which may eventually exist near the fuel, without significant decomposition or burning. The use of such material is believed to help maintain the simple "smoke" chemistry of the aerosol, as evidenced by a lack of Ames test activity in the preferred embodiments. While not preferred, other aerosol generating means, such as heat rupturable microcapsules, or solid aerosol forming substances, are within the scope of this invention, provided they are capable of releasing sufficient aerosol forming vapors to satisfactorily resemble tobacco smoke.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include adsorbent carbons, such as porous grade carbons, graphite, activated, or non-activated carbons, and the like, such as PC-25 and PG-60 avialable from Union Carbide Corp., Danbury, CT, as well as SGL carbon, available from Calgon. Other suitable materials include inorganic solids, such as ceramics, glass, alumina, vermiculite, clays such as bentonite, and the like. Carbon and alumina substrates are preferred.

An especially useful alumina substrate is available from the Davison Chemical Division of W.R. Grace & Co. under the designation SMR-14-1896. Before use, this alumina is sintered at elevated temperatures, e.g., greater than 1000° C., washed, and dried.

It has been found that suitable particulate substrates also may be formed from carbon, tobacco, or mixtures of carbon and tobacco, into densified particles in a one-step process using a machine made by Fuji Paudal KK of Japan, and sold under the trade name of "Marumerizer." This apparatus is described in German Pat. No. 1,294,351 and U.S. Pat. No. 3,277,520 (now reissued as U.S. Pat. No. 27,214) as well as Japanese published specification U.S. Pat. No. 8684/1967.

The aerosol forming substance or substances used in the cartridges of the present invention must be capable of forming an aerosol at the temperatures present in the aerosol generating means upon heating by the burning fuel element. Such substances preferably will be composed of carbon, hydrogen and oxygen, but they may include other materials. Such substances can be in solid, semisolid, or liquid form. The boiling or sublimation point of the substance and/or the mixture of substances can range up to about 500° C. Substances having these characteristics include: polyhydric alcohols, such as glycerin, triethylene glycol, and propylene glycol, as well as aliphatic esters of mono- di-, or poly-carboxylic acids, such as methyl stearate, dimethyl dodecandioate, dodecandiote, dimethyl tetradecanedioate and others.

The preferred aerosol forming substances are polyhydric alcohols, or mixtures of polyhydric alcohols. More preferred aerosol formers are selected from glycerine, triethylene glycol and propylene glycol.

When a substrate material is employed as a carrier, the aerosol forming substance may be dispersed on or within the substrate in a concentration sufficient to permeate or coat the material, by any known technique. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 120 mg, preferably from about 35 mg to about 85 mg, and most preferably from about 45 mg to about 65 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other deisrable volatile solid or liquid materials.

One particularly preferred aerosol generating means comprises the aforesaid alumina substrate containing spray dried tobacco extract, tobacco flavor modifiers, such as levulinic acid, one or more flavoring agents, and an aerosol forming agent, such as glycerin. In certain preferred embodiments, this substrate may be mixed with densified tobacco particles such as those produced on a "Marumerizer."

Articles of the type disclosed herein may be used or may be modified for use as drug delivery articles, for delivery of volatile pharmacologically or physiologically active materials such as ephedrine, metaproterenol, terbutaline, or the like.

The heat conducting member preferably employed in fabricating the cartridge of the present invention is typically a metallic foil, such as aluminum foil, varying in thickness from less than about 0.01 mm to about 0.1 mm, or more. The thickness and/or the type of conducting material may be varied (e.g., Grafoil, from Union Carbide) to achieve virtually any desired degree of heat transfer. As shown in the illustrated embodiment, the heat conducting material prefeably contacts or overlaps a portion of the fuel element, and forms the container which encloses the aerosol forming substance.

Preferably, the heat conducting member extends over no more than about one-half the length of the fuel element. More preferably, the heat conducting member overlaps or otherwise contacts no more than about the rear 5 mm of the fuel element when it has been consumed to the point of contact with the conducting member by acting as a heat sink.

The diameter of the cartridges of the present invention may be varied depending upon the amount of aerosol to be delivered and the desired number of puffs to be generated. For example, the 10 mm fuel element/30 mm long container of the illustrated embodiments provides from about 10 to 15 puffs with large quantities of aerosol during typical smoking. By adjusting the dimensions of the cartridge components and/or the aerosol generating means, both the quantity of aerosol produced and the number of available puffs can be adjusted.

In certain embodiments of the invention, the cartridge will be attached to the bowl of a conventional pipe by means of a bowl conversion member. One such conversion member is illustrated in FIGS. 1 and 2. This bowl conversion member should be prepared from a heat resistant material, preferably the same material as the pipe in which it is used. Examples of such materials include briarwood, clays, and the like. The conversion member should be shaped to fit snugly inside the pipe bowl. The draft hole at the bottom of the pipe bowl must not be blocked by the conversion member. Gases drawn from the cartridge flow into the draft hole of the pipe bowl, pass to the stem and are delivered to the user akin to coventional pipe tobacco smoke.

In other embodiments, such as the pipe illustrated in FIGS. 3 and 4, the pipe bowl itself may be designed to accept the cartridge of the present invention, without the need of any adapter/conversion member. Furthermore, in such embodiments a cartridge ejection means may advantageously be provided in order to facilitate the removal of spent cartridges from the pipe bowl. One such ejection means is illustrated in FIG. 3. This ejection means operates as a slidable shaft which contacts the bottom portion of the cartridge and when pressed upward, exerts force on the cartridge removing it from its position within the bowl. Other ejection means will be readily apparent to the skilled artisan upon consideration of this disclosure.

The aerosol produced by the preferred articles of the present invention is chemically simple, consisting essentially of air, oxides of carbon, aerosol former including any desired flavors or other desired voltile materials, water and trace amounts of other materials. The WTPM produced by the preferred articles of this invention has no mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., *Mut. Res.*, 31: 347–364 (1975); Nagas et al., *Mut. Res.*, 42: 335 (1977).

A further benefit from the preferred embodiments of the present invention is the relative lack of ash produced during use in comparison to ash from a conventional pipe. As the preferred carbon fuel element is burned, it is essentially converted to oxides of carbons, with relatively little ash generation.

The smoking article of the present invention will be further illustrated with reference to the following example which will aid in the understanding of the present invention, but which is not to be construed as a limitation thereof. All percentages reported herein, unless otherwise specified, are percent by weight. All temperatures are expressed in degrees Celsius and are uncorrected.

EXAMPLE 1

A pipe substantially as illustrated in FIG. 1 was prepared in the following manner.

A conventional briar wood pipe having a bowl about 40 mm deep, about 30 mm outer diameter, and about 18 mm inner diameter, was modified by inserting therein an adapter which consisted of a section of briar wood, about 17 mm wide, about 5 mm thick, having a centrally drilled hole of about 5 mm diameter. This adapter fit snugly into the pipe bowl and centered the hole above the bottom of the pipe bowl.

The carbon was prepared by pyrolyzing Grande Prairie Canadian Kraft paper (hardwood, non-talc grade) at a carbonizing temperature of 550° C. for 8 hours. After cooling, the carbon was ground to an average particle size of less than about 10 microns. The powdered carbon was then heated under a nitrogen sweep gas to a temperature of 850° C. and held at that temperature for 8 hours.

A fuel element (10 mm long, 4.5 mm o.d.) having an apparent (bulk) density of about 0.86 g/cc, was prepared by admixing the carbon powder (89 weight percent), SCMC binder (10 wt. percent) and $K_2CO_3$ (1 wt. percent) with sufficient water to make an extrudable paste.

The fuel element was extruded with seven holes (each about 0.6 mm diameter) in a somewhat closely spaced arrangement (similar to FIG. 4) with a core diameter, i.e., the diameter of the smallest circle which will circumscribe the holes in the fuel element) of about 2.6 mm and spacing between the holes of about 0.3 mm.

The capsule for the aerosol generating means was prepared from drawn aluminum tubing (from Niemand, Inc.), about 32 mm in length, having an outer diameter of about 4.5 mm. The rear 2 mm of the capsule was crimped to seal the mouth end of the capsule. At the mouth end, two slots, each about 0.65 mm×3.45 mm were cut into the sealed wall.

High surface area alumina (surface area=280 $m^2/g$) from W.R. Grace & Co. (designated SMR-14-1896), having a mesh size of from −8 to +14 (U.S.) was sintered at a soak temperature above about 1400° C., preferably from about 1400° to 1550° C., for about one hour and cooled. The alumina was washed with water.

The alumina (640 mg) was dried to a moisture content of from about 1 to 5, preferably about 3.5, weight percent. This material was then treated with a mixture of 233 mg of glycerin and a flavor mixture; comprising (by weight) 0.25% of phenyl ethyl alcohol, 0.35% Tabac (chocolate) and 0.35% coffee. The capsule was filled with a 200 mg of a 1:1 mixture of the this treated alumina and densified (i.e., Marumerized) flue cured tobacco having a density of about 0.8 g/cc, loaded with about 15 wt. percent glycerin.

The fuel element was inserted into the open end of the filled capsule to a depth of about 3 mm, forming the preferred cartridge of the present invention. This cartridge was inserted into the pipe bowl converter to a depth of about 5 mm, thereby leaving about 3 mm of clearance between the top of the fuel element and the rim of the pipe bowl.

Upon smoking this article, good aerosol delivery was achieved on virtually each of the 11 puffs taken. Flavor was good and there was no sidestream smoke, and very little ash after the fuel element was consumed.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A pipe having a bowl comprising:
   (a) a replaceable cartridge, which cartridge comprises:
      (i) a fuel element less than about 30 mm in length; and
      (ii) a physically separate aerosol generating means in a conductive heat exchange relationship with the fuel element, the aerosol generating means including at least one aerosol forming material; and
   (b) means for retaining the cartridge in the bowl of the pipe, the retaining means being adapted to permit removal and replacement of the cartridge.

2. The pipe of claim 1, further comprising means for ejecting the cartridge from the bowl of the pipe.

3. The pipe of claim 1, wherein the retaining means comprises a removable member having a passageway in communication with the passageway of the stem of the pipe, the passageway in the removable member being adapted to receive the removable cartridge.

4. The pipe of claim 1, wherein the cartridge comprises a conductive container which encloses at least a portion of the aerosol generating means.

5. The pipe of claim 1, wherein the cartridge does not extend above the rim of the pipe bowl.

* * * * *

UNITED STATES PATENT AND TRADEMARK OFFICE

CERTIFICATE OF CORRECTION

PATENT NO. : 4,708,151

DATED : November 24, 1987

INVENTOR(S) : Gary R. Shelar

It is certified that error appears in the above-identified patent and that said Letters Patent is hereby corrected as shown below:

Column 8, line 34, "avialable" should read -- available --.

Column 8, line 68, delete "dodecandiote,".

Column 9, line 32, "deisrable" should read -- desirable --.

Column 9, line 55, "prefeably" should read -- preferably --.

Signed and Sealed this

Fifth Day of July, 1988

*Attest:*

DONALD J. QUIGG

*Attesting Officer*

*Commissioner of Patents and Trademarks*